US005839927A

United States Patent [19]

Thomas et al.

[11] Patent Number: 5,839,927

[45] Date of Patent: Nov. 24, 1998

[54] WATER JET SYSTEM

[75] Inventors: Mark Anthony Thomas, San Jose, Calif.; John G. Stricker, Berlin, Md.

[73] Assignee: United Defense, LP, Arlington, Va.

[21] Appl. No.: 741,798

[22] Filed: Oct. 31, 1996

[51] Int. Cl.[6] ..... B63H 11/117

[52] U.S. Cl. ..... 440/43; 440/46; 440/47

[58] Field of Search ..... 440/38, 39, 40, 440/41, 42, 43, 44, 45, 46, 47, 78; 114/151, 150

[56] References Cited

U.S. PATENT DOCUMENTS

| | | | |
|---|---|---|---|
| 3,147,733 | 9/1964 | Engel | 440/46 |
| 3,420,204 | 1/1969 | Samuel | 115/1 |
| 3,809,005 | 5/1974 | Rodler, Jr. | 115/398 |
| 3,834,342 | 9/1974 | Schoell | 440/41 |
| 3,983,832 | 10/1976 | Kinder | 115/1 R |
| 3,993,015 | 11/1976 | Klepacz | 440/41 |
| 4,073,257 | 2/1978 | Rodler, Jr. | 115/12 R |
| 4,470,364 | 9/1984 | Kitaura et al. | 440/78 |
| 4,953,492 | 9/1990 | Duffty | 114/282 |
| 5,244,425 | 9/1993 | Tasaki et al. | 440/47 |
| 5,577,941 | 11/1996 | Chartier | 440/46 |

OTHER PUBLICATIONS

Brochure: "KaMeWao Marine Laboratory" (8 pages) General disclosure of the KaMeWa Marine Laboratory.

Flyer: "KaMeWa FF–Jet 450, Water–Jet Propulsion for Maritime Professionals" (2 pages) Specifications and photographs.

Brochure: "Wate jets by KaMeWa, The Ultimate in Propulsion"(16 pages) General disclosure of the KaMeWa Water jets.

*Primary Examiner*—Stephen Avila

*Attorney, Agent, or Firm*—Douglas W. Rudy; Michael B. K. Lee

[57] ABSTRACT

The invention provides a water jet system with higher efficiency and better steering. The water jet system uses cantilever bars for an inlet grating, to prevent blockage. The water jet system also uses an elliptical impeller shaft housing to reduce turbulence and snagging of debris by the rotating impeller shaft. The water jet system uses impeller blades with a curved cross section that curves towards the direction of forward rotation. The water jet system uses U-shaped flanges mounted to the outlet of the water jet to provide steering.

14 Claims, 5 Drawing Sheets

WATER JET SYSTEM

BACKGROUND OF THE INVENTION

The present invention relates to a method and apparatus for creating a jet of water. Water jet systems are useful for propelling a vehicle in water, such as boats, hydrofoils and amphibious vehicles. It is desirable the provide a greater efficiency in water jet propulsion systems. Gratings are often used over an inlet for a water jet system. These gratings often become a debris trap, reducing the efficiency of the water jet system. The deflection of the water jet impeller blades normally reduces the efficiency of the impeller blades. A water jet drive shaft rotating through the flow of water creates flow obstruction and hydrodynamic drag, which decreases the water jet system's efficiency.

The ability to turn vehicles propelled by water jets is useful. Most water jet steering systems extend the length of the water jet system and provide a less efficient steering.

SUMMARY OF THE INVENTION

It is an object of the invention to provide a water jet system with increased efficiency.

It is another object of the invention to provide a more efficient and compact steering system.

The invention provides a water jet system with a cantilever inlet, a shaft housing, improved impeller blade angles, and a compact steering system, for improved efficiency, dimensions, and steering.

DESCRIPTION OF THE PREFERRED EMBODIMENTS

Figure 1:
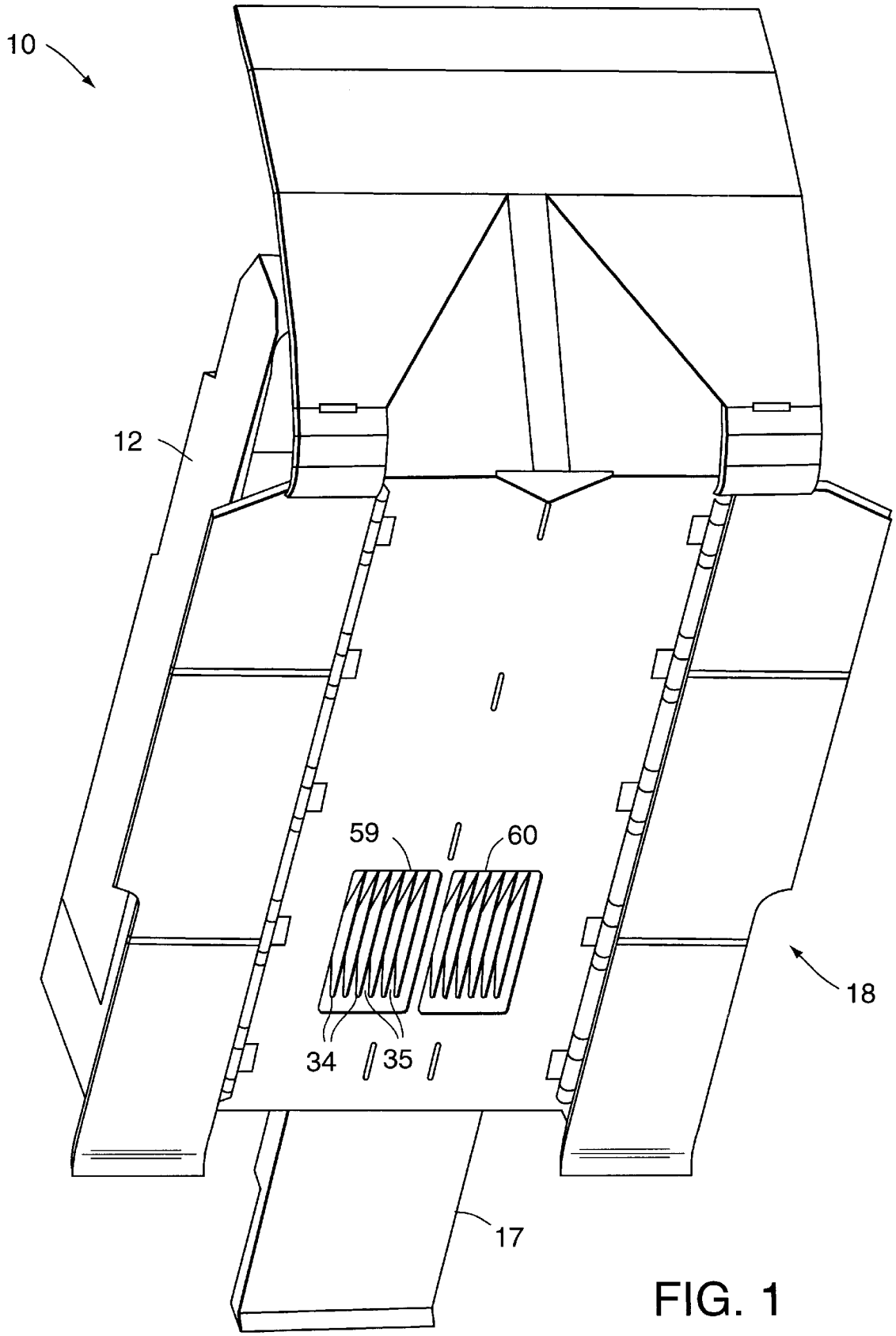
FIG. 1 is a bottom perspective view of an amphibious vehicle 10 that uses the inventive water jet system.
Figure 2:
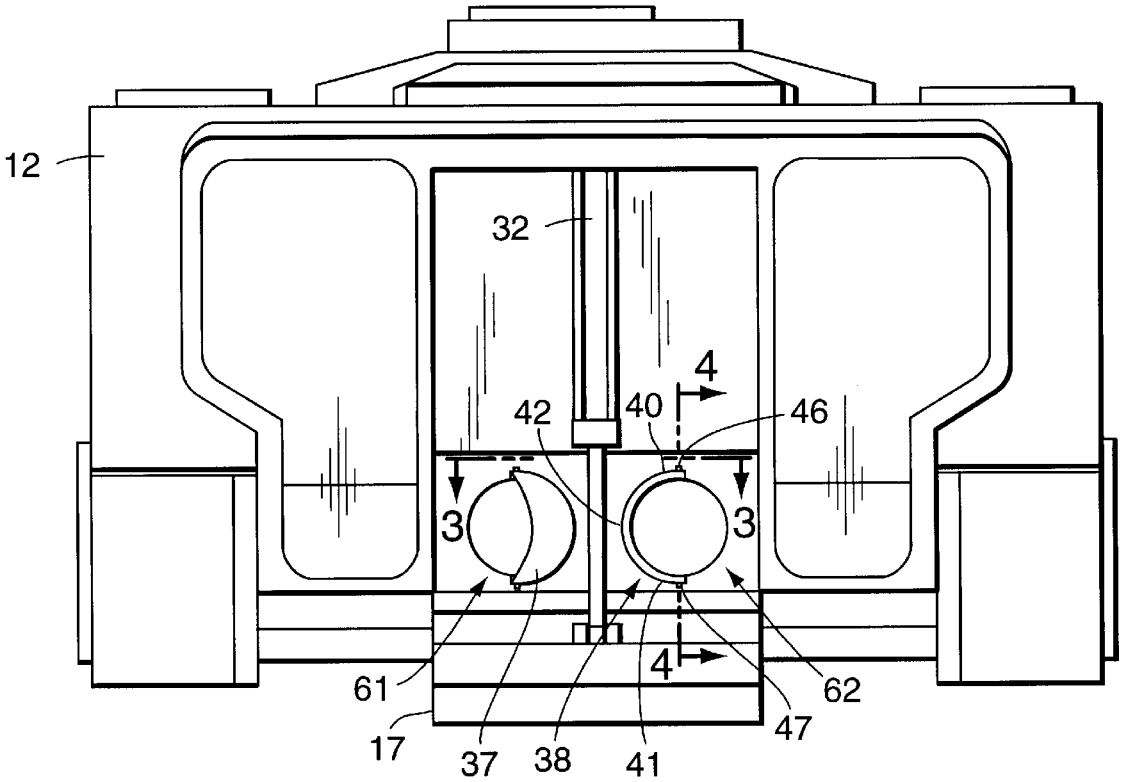
FIG. 2 is an end view of the amphibious vehicle shown in FIG. 1.

FIG. 1 is a bottom perspective view of an amphibious vehicle that uses a preferred embodiment of the inventive water jet system. FIG. 2 is an end view of the amphibious vehicle 10 shown in FIG. 1. The amphibious vehicle 10 has a hull 12, which is able to float in water. A first water inlet 59 is mounted under the hull 12. A second water inlet 60 is mounted under the hull 12 adjacent to the first water inlet 59. A transom flap 17 is connected to an end of the hull 12 by a hinge. A hydraulic cylinder 32 extends from the hull 12 to the transom flap 17, to raise and lower the transom flap 17. A first water jet outlet 61 is mounted at the end of the hull 12 adjacent to the transom flap 17. A second water jet outlet 62 is mounted at the end of the hull adjacent to the transom flap 17 and the first water jet outlet 61.

Figure 3:
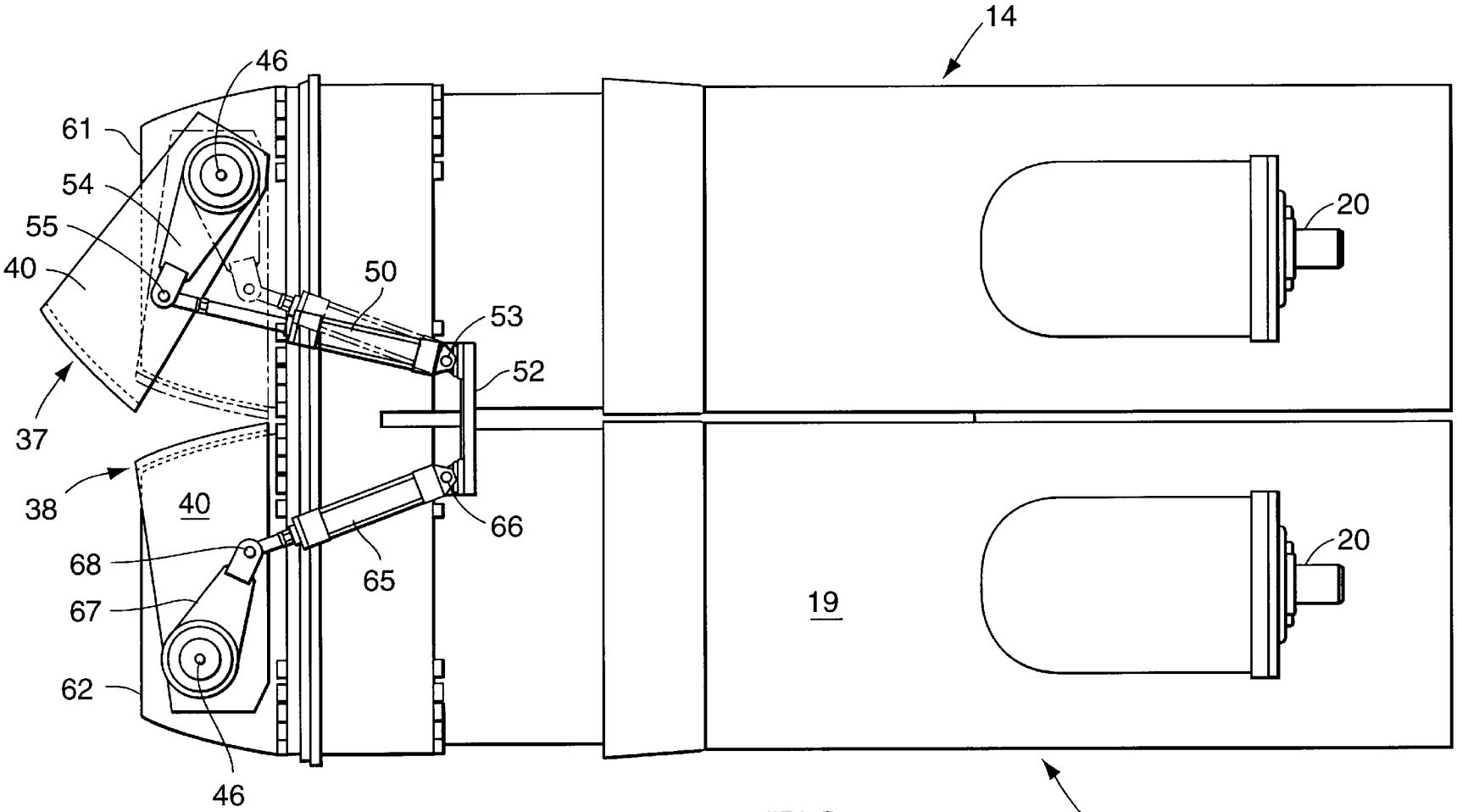
FIG. 3 is a top view of the water jet systems shown in FIG. 2, along lines 3—3.

FIG. 3 is a top view of the water jet systems shown in FIG. 2, along lines 3—3. A first water jet system 14 extends between the first water inlet 60 and the first water jet outlet 61. A second water jet system 15 extends between the second water inlet 59 and the second water jet outlet 62.

Figure 4:
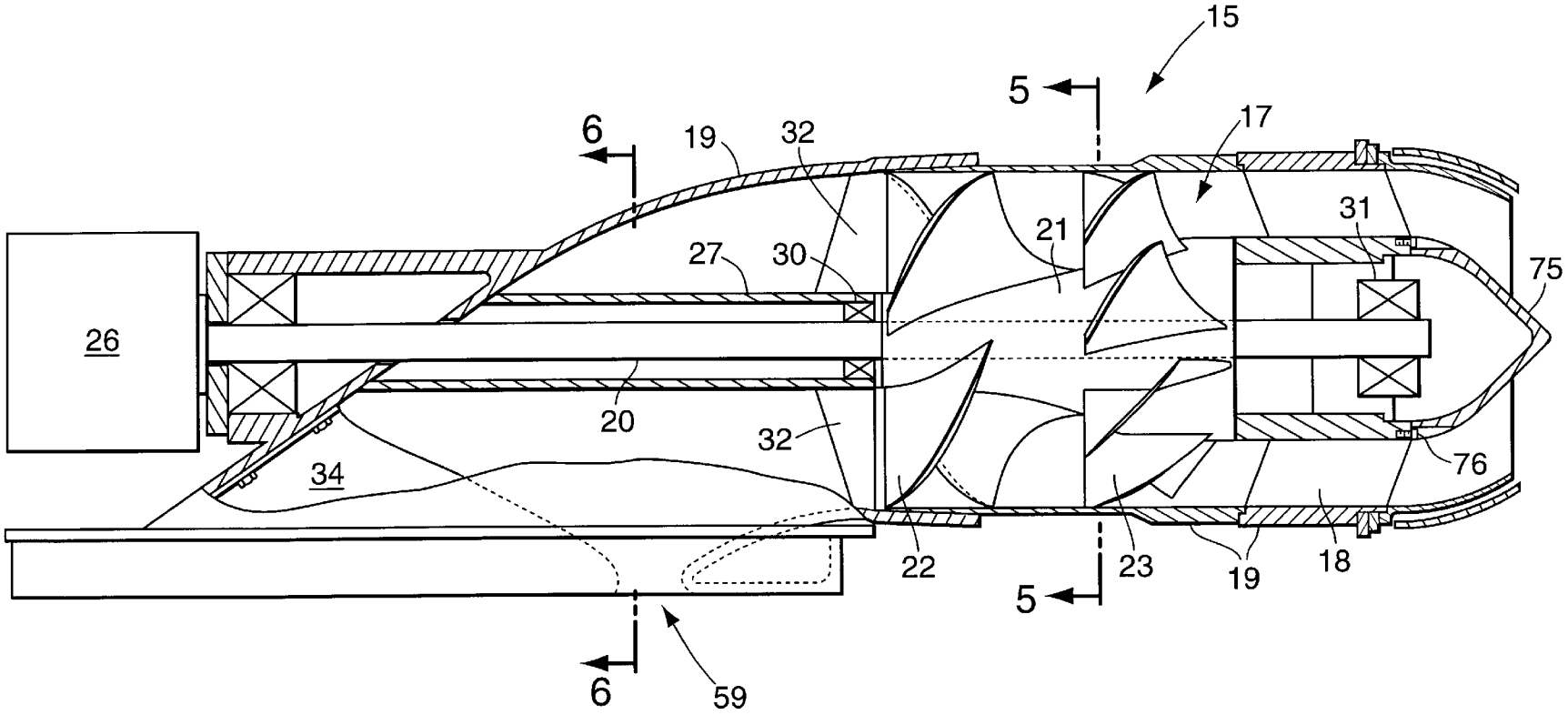
FIG. 4 is cross sectional view of a water jet system shown in FIG. 2, along lines 4—4.

FIG. 4 is cross sectional view of the second water jet system 15 shown in FIG. 2, along lines 4—4. Since the first water jet system and the second water jet system are identical, only the second water jet system 15 will be described in detail. The second water jet system 15, comprises an impeller 17, adjacent to a stator 18, and within a water jet housing 19. The water jet housing 19, comprises a first end, which is the second water inlet 59, a second end, which is the second water jet outlet 62, and a main body, which extends between the first end and the second end. The impeller 17 comprises, an impeller drive shaft 20, a hub 21 surrounding part of the impeller drive shaft 20, a first row of impeller blades 22 mechanically connected to the hub 21, and a second row of impeller blades 23 mechanically connected to the hub 21. In this embodiment, the hub 21 is one piece. In other embodiments, the hub may be two or more pieces keyed to the impeller drive shaft. The impeller drive shaft 20, is mechanically connected to a transmission system 26 outside of the water jet housing 19 at a first end of the impeller shaft 20. The impeller drive shaft 20 extends from the first end of the impeller drive shaft 20, into the water jet housing 19, and through a first drive shaft bearing 29. The first drive shaft bearing 29 rotatably supports an end of the impeller drive shaft 20 closest to the transmission system 26. A drive shaft shroud 27, covers the impeller drive shaft 20, from the water jet housing 19 to a second drive shaft bearing 30. The second drive shaft bearing 30 rotatably supports an end of the impeller drive shaft 20 closest to the first row of impeller blades 22. One or more struts 32 support an end of the drive shaft shroud 27 adjacent to the first row of impeller blades 22 and the second drive shaft bearing 30. The impeller drive shaft 20, passes through the hub 21, which is keyed to the impeller drive shaft 20. The second drive shaft bearing 30 is adjacent to a first side of the hub 21. A third drive shaft bearing 31 is adjacent to a second side of the hub 21 opposite from the first side of the hub 21, wherein the third drive shaft bearing 31 is in the center of and is supported by the stator 18. The impeller drive shaft 20 passes through the third drive shaft bearing 31 and terminates at a second end of the impeller drive shaft 20. A tail cone 75 is mechanically connected to the stator 18 by mounting screws 76, and covers the second end of the impeller drive shaft 20.

A plurality of cantilever bars 34 are mechanically connected to the water jet housing 19 adjacent to the second water inlet 59. The cantilever bars 34 are only connected at one end, with a cantilever gap 35 between ends of the cantilever bars 34 furthest away from the connected end and the closes part of the housing 19. The cantilever bars 34 have a length extending between the connected end and the end furthest way from the connected end, wherein the lengths of the plurality of cantilever bars 34 are parallel to each other. Bolts 44 (FIG. 6) are used to mechanically connect the cantilever bars 34 to the water jet housing 19 to make them removable. The water jet housing 19 may be formed from several parts bolted together, so that different parts of the water jet housing 19 are removable.

Adjacent to the water jet housing near the first water jet outlet 61 is a first steering bucket 37. Adjacent to the water jet housing 19 near the second water jet outlet 62 is a second steering bucket 38. The first and second steering buckets 37, 38 have a U-shaped cross section with a first leg 40, a second leg 41, and a middle portion 42 connected between the first leg 40 and the second leg 41 to form the U-shape, as shown in FIG. 2. A first hinge 46 mechanically connects the first leg 40 to the water jet housing 19 in a manner that allows the first leg 40 to rotate with respect to the water jet housing 19.

A second hinge 47 mechanically connects the second leg 41 to the water jet housing 19 in a manner that allows the second leg 41 to rotate with respect to the water jet housing 19.

A first hydraulic cylinder 50 is mechanically connected between the water jet housing of the first water jet system 14 and the first steering bucket 37. A flange 52 is bolted to the water jet housings of the first water jet system 14 and the second water jet system 15. The first hydraulic cylinder 50 is connected to the flange 52 by a first flange hinge 53. The flange 52 and the first flange hinge 53 mechanically connect the first hydraulic cylinder 50 to the water jet housing of the first water jet system 14. A first pivot arm 54 is welded to the first steering bucket 37 at the first leg. The first hydraulic cylinder 50 is connected to the first pivot arm 54 by a first pivot arm hinge 55. The first pivot arm 54 and the first pivot arm hinge 55 mechanically connect the first hydraulic cylinder 50 to the first steering bucket 37.

A second hydraulic cylinder 65 is mechanically connected between the water jet housing 19 of the second water jet system 15 and the second steering bucket 38. The flange 52 is bolted to the water jet housings of the first water jet system 14 and the second water jet system 15. The second hydraulic cylinder 65 is connected to the flange 52 by a second flange hinge 66. The flange 52 and the second flange hinge 66 mechanically connect the second hydraulic cylinder 65 to the water jet housing 19 of the second water jet system 15. A second pivot arm 67 is welded to the second steering bucket 38 at the first leg 40. The second hydraulic cylinder 65 is connected to the second pivot arm 67 by a second pivot arm hinge 68. The second pivot arm 67 and the second pivot arm hinge 68 mechanically connect the second hydraulic cylinder 65 to the second steering bucket 38.

When the hydraulic cylinder is completely contracted as shown with the second hydraulic cylinder 65, the steering bucket is on the side of the water jet housing mating with the water jet outlet. The water is not diverted. When the hydraulic cylinder is completely extended as shown in solid lines with the first hydraulic cylinder 50, the first steering bucket 37 is placed in the water flow from the first water jet outlet 61, causing a turning force.

Figure 5:
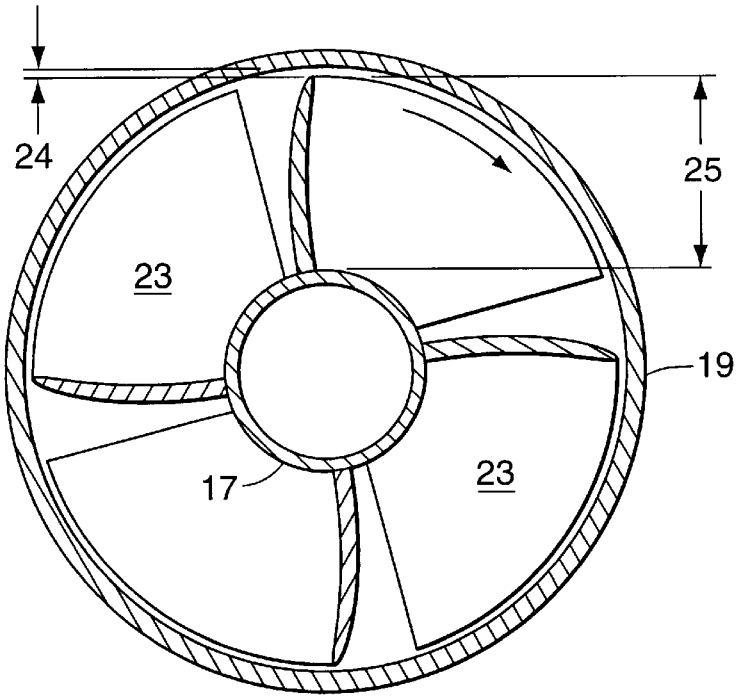
FIG. 5 is a cross sectional view of the water jet system shown in FIG. 4, along lines 5—5.

FIG. 5 is a cross sectional view of the second water jet system 15 shown in FIG. 4, along lines 5—5, showing a cross section of the second row of impeller blades 23 within the water jet housing 19. When the amphibious vehicle is moving in a forward direction, the impeller 17 rotates in a clockwise direction as shown by the arrow. The cross sections of the first row of impeller blades 23 are curved towards the direction of rotation. This means that the concaved part of the cross sections of the first row of impeller blades is in the direction of rotation for forward travel. A blade gap 24 is between the first row of impeller blades 23 and the housing 19, when the impeller 17 is not rotating. The blade height 25 is the distance from the hub to the tip of a blade of the first row of impeller blades 23. In this embodiment, the blade gap 24 is 4% of the blade height 25. In other embodiments, the blade gap 24 is between 3 to 7% of the blade height 25. In other embodiments the blade gap 24 is between 2 to 10% of the blade height 25. The cross sections of the first row of impeller blades 22 is also curved in the same way to provide a blade gap.

Figure 6:
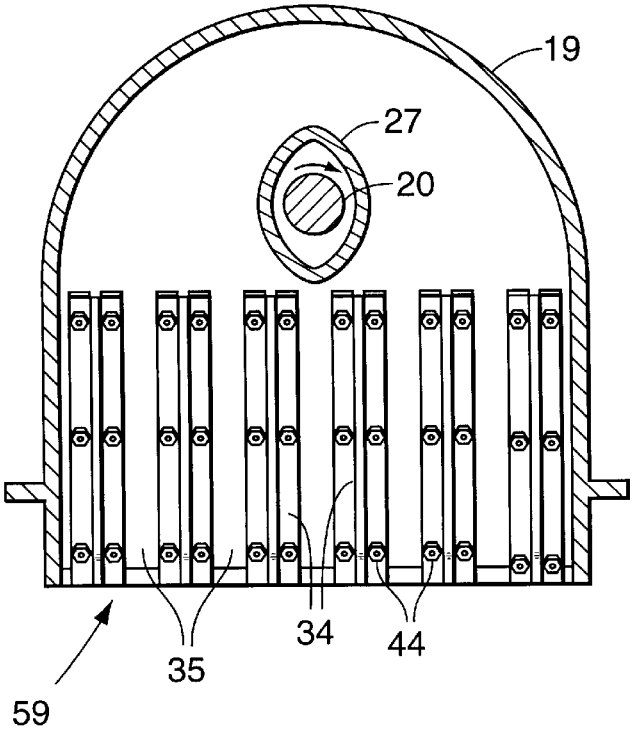
FIG. 6 is a cross sectional view of the water jet system shown in FIG. 4, along lines 6—6.

FIG. 6 is a cross sectional view of the second water jet system 15 shown in FIG. 4, along lines 6—6. As discussed above, a plurality of cantilever bars 34 are bolted at one end to the housing 19. The impeller drive shaft 20 is housed in a drive shaft shroud 27, which has an elliptical cross section, so that the longest dimension of the ellipse is along a path towards the second water inlet 59, as shown. In the specification and claims the elliptical cross section includes an air foil shape, a flat tear drop shape, and any other flat shape with curved sides.

In operation, the amphibious vehicle 10 is in water. To travel in a forward direction the transmission system 26 drives the impeller drive shaft 20 in a clockwise direction as viewed in FIGS. 5 and 6 and shown by the arrows in FIGS. 5 and 6. This causes water to be drawn into the first water inlet 60 and the second water inlet 59. The water passes the drive shaft shroud 27 to the first row of impeller blades 22. The water passes to the second row of impeller blades 23, and then through the stator 18, to the first and second water jet outlets 61, 62.

To make the amphibious vehicle 10 travel straight ahead, both the first hydraulic cylinder 50 and the second hydraulic cylinder 65 are fully contracted. This causes both the first steering bucket 37 and the second steering bucket 38 to be positioned on the side of the water jet housings away from the flow of the water. To turn left, the first hydraulic cylinder 50 is extended, moving the first steering bucket 37 from beside the water jet housing, to a position behind the first water jet outlet 61, as shown in FIG. 3. The bucket shape of the middle portion 42 of the first steering bucket 37 diverts some of the water passing out of the first water jet outlet 61 to the left, causing the amphibious vehicle 10 to move to the left as the amphibious vehicle 10 moves forward. To turn to the right, the first hydraulic cylinder 50 is contracted and the second hydraulic cylinder 65 is extended.

To travel in a backwards direction, the transmission system 26 drives the impeller drive shaft 20 in a counter clockwise direction as viewed in FIGS. 5 and 6, which is opposite from the arrows shown in FIGS. 5 and 6. This causes water to be drawn into the first and second water jet outlets 61, 62 and pushed out of the first and second water inlets 60, 59. An advantage of such a reversible system is that if objects enter and lodge in the water jet system, while traveling in a forward direction, by reversing the system the objects may be cleared from the water jet system.

The cantilever bars 34 prevents large foreign objects from entering the water jet system, protecting the water jet system from damage. If long thin objects, such as grass or string wrap around the cantilever bars 34, the forward movement of the amphibious vehicle, pushes such objects to the cantilever gap 35, allowing such objects to enter the water jet system, where they are able to pass through the water jet system. This prevents long thin objects from remaining on the cantilever bars 34, which could eventually build up to block the water inlets. For a preferred spacing that allow long thin objects to pass through and yet prevent objects that are too large from entering the cantilever gap 35 should be between 0.5 inches to 2 inches. The planar shape of the cantilever bars 34 reduces turbulence.

As the water passes the region of the impeller drive shaft 20, the drive shaft shroud 27 shields the impeller drive shaft 20. This prevents long flexible objects from wrapping around the rotating impeller drive shaft 20, which could reduce the water jet system efficiency. The also prevents the rotating impeller drive shaft 20 from adding turbulence to the passing water, which would also reduce the water jet system efficiency. The elliptical shape of the drive shaft shroud 27, reduces water drag, increasing the water jet efficiency system. Using three sets if bearings to support the impeller drive shaft 20 allows for a thinner impeller drive shaft 20, which fits in the low drag profile drive shaft shroud 27.

While rotating in the clockwise direction for forward movement at high speeds as viewed in FIG. 5, the water pressure causes the curved cross sections of the second row of impeller blades 23 to become straighter. This reduces the blade gap 24 to 1% or less of the blade height 25, providing for a greater efficiency in the forward direction, where higher speeds are desired. In the same way, the first row of impeller blades 22 also become straighter, providing for a greater efficiency. While rotating in the counter-clockwise direction for reverse movement, the water pressure causes the curved cross-section of the second row of impeller blades 23 to become more curved, increasing the blade gap 24, reducing water jet efficiency. Since high speed is not desired in the reverse direction, a lower efficiency is acceptable.

In the prior art, a impeller blades had a straight cross section with a minimum blade gap. The most efficient blades with a straight cross section have blade gaps which are 1% of the blade height. The rotation of the impeller in a forward or reverse direction would increase the gap, causing a reduction in efficiency in the forward and reverse directions. If the blade cross-section is curved away from the forward direction of rotation, then a forward rotation would increase the gap, again reducing efficiency. A reverse rotation, would reduce the gap, and could cause binding.

The steering buckets, provide steering diverters that are close to the water outlets for higher turning efficiency. The steering buckets do not add considerably to the length of the water jet system, allowing for a shorter water jet system.

While preferred embodiments of the present invention have been shown and described herein, it will be appreciated that various changes and modifications may be made therein without departing from the spirit of the invention as defined by the scope of the appended claims.

What is claimed is:

1. A water jet system, comprising:

a water jet housing, with an inlet and an outlet;

an impeller, comprising:

an impeller drive shaft; and a first row of impeller blades around the impeller drive shaft;

a plurality of cantilever bars with a first end and a second end, wherein the first end is mechanically connected to the housing at the inlet of the water jet housing and wherein the second end is spaced apart from the water jet housing by a distance of between 0.5 inches and 2 inches;

a shaft housing surrounding part of the impeller drive shaft, wherein the shaft housing extends into the water jet housing, wherein shaft housing has an elliptical cross section;

a first set of bearings for supporting the impeller drive shaft, and mechanically connected to the water jet housing;

a second set of bearings for supporting the impeller drive shaft and mechanically connected to the water jet housing;

a stator mechanically connected to the water jet housing, wherein the stator is located between the water jet housing outlet and the first row of impeller blades; and a third set of bearings for supporting the impeller drive shaft, and mechanically connected to the stator, and wherein the first row of impeller blades is located between the second set of bearing and the third set of bearings.

2. The water jet system, as claimed in claim 1, wherein the impeller has a rotational direction for forward movement of the water jet system, and wherein the first row of impeller blades have a cross section that is curved towards the rotational direction for forward movement.

3. The water jet system, as claimed in claim 2, wherein the first row of impeller blades have a height and wherein the first row of impeller blades are spaced from the housing by a blade gap of between 2 to 10% of the height.

4. The water jet system, as claimed in claim 3, further comprising:

a hydraulic cylinder mechanically connected to the water jet housing; and a steering bucket with a U-shaped cross section adjacent to the outlet of the water jet housing, rotatably connected to the housing and mechanically connected to the hydraulic cylinder.

5. A water jet system, comprising:

a water jet housing, with an inlet and an outlet;

an impeller, comprising:

an impeller drive shaft; and a first row of impeller blades around the impeller drive shaft, wherein the impeller has a rotational direction for forward movement of the water jet system, and wherein the first row of impeller blades have a cross section that is curved towards the rotational direction for forward movement; and a plurality of cantilever bars with a first end and a second end, wherein the first end is mechanically connected to the housing at the inlet of the water jet housing and wherein the second end is spaced apart from the water jet housing.

6. The water jet system, as claimed in claim 5, wherein the first row of impeller blades have a height and wherein the first row of impeller blades are spaced from the housing by a blade gap of between 2 to 10% of the height.

7. The water jet system, as claimed in claim 6, further comprising:

a hydraulic cylinder mechanically connected to the water jet housing; and a steering bucket with a U-shaped cross section adjacent to the outlet of the water jet housing, rotatably connected to the housing and mechanically connected to the hydraulic cylinder.

8. A water jet system, comprising:

a water jet housing, with an inlet and an outlet;

an impeller, comprising an impeller drive shaft; and a first row of impeller blades around the impeller drive shaft;

a hydraulic cylinder mechanically connected to the water jet housing; and a steering bucket with a U-shaped cross section adjacent to the outlet of the water jet housing, rotatably connected to the housing and mechanically connected to the hydraulic cylinder, wherein the steering bucket mates with the water jet housing, so that when the steering bucket is completely retracted, the steering bucket is on the side of the water jet housing so that a rear most edge of the steering bucket is mated to the water jet outlet, so that the rear most edge of the steering bucket is substantially even with the water jet outlet.

9. The water jet system, as claimed in claim 8, wherein the impeller has a rotational direction for forward movement of the water jet system, and wherein the first row of impeller blades have a cross section that is curved towards the rotational direction for forward movement.

10. The water jet system, as claimed in claim 9, wherein the first row of impeller blades have a height and wherein the first row of impeller blades are spaced from the housing by a blade gap of between 2 to 10% of the height.

11. The water jet system, as claimed in claim 10, further comprising: a shaft housing surrounding part of the impeller drive shaft, wherein the shaft housing extends into the water jet housing.

12. The water jet system, as claimed in claim 11, further comprising:

a first set of bearings for supporting the impeller drive shaft, and mechanically connected to the water jet housing; and a second set of bearings for supporting the impeller drive shaft and mechanically connected to the water jet housing.

13. The water jet system, as claimed in claim 12, wherein shaft housing has an elliptical cross section.

14. A water jet system, comprising:

a water jet housing with an inlet and an outlet, an impeller, comprising:

an impeller drive shaft; and a first row of impeller blades around the impeller drive shaft, a first set of bearings adjacent to the first row of impeller blades surrounding the impeller drive shaft;

a second set of bearings for supporting the impeller drive shaft, wherein the first row of impeller blades is located between the first set of bearings and the second set of bearings;

a first bearing support, mechanically connected between the water jet housing and the first set of bearings;

a second bearing support, mechanically connected between the water jet housing and the second set of bearings, wherein the second bearing support forms a stator; and a shaft housing surrounding part of the impeller drive shaft and connected to the water jet housing, wherein the shaft housing extends into the water jet housing from where the shaft housing is connected to the water jet housing to the first bearing support, wherein the shaft housing has an elliptical cross section.

* * * * *